United States Patent [19]

Catthoor

[11] Patent Number: 4,582,163

[45] Date of Patent: Apr. 15, 1986

[54] ELECTRO-ACOUSTIC TRANSDUCER WITH HIGH AIR PERMEABLE DIAPHRAGM

[75] Inventor: Raphaël F. A. Catthoor, Temse, Belgium

[73] Assignee: U.S. Philips Corporation, New York, N.Y.

[21] Appl. No.: 607,336

[22] Filed: May 4, 1984

[30] Foreign Application Priority Data

May 10, 1983 [NL] Netherlands ..... 8301653

[51] Int. Cl.[4] ..... H04R 7/00

[52] U.S. Cl. ..... 181/169; 181/157; 181/172; 179/115.5 R

[58] Field of Search ..... 181/157, 167, 169, 172; 179/115.5 R

[56] References Cited

U.S. PATENT DOCUMENTS

| | | | |
|---|---|---|---|
| 1,917,309 | 7/1933 | Leopold | 181/169 |
| 2,007,750 | 7/1935 | Carlisle | 179/115.5 R |
| 2,866,515 | 12/1958 | Hunter | 181/172 |
| 3,930,130 | 12/1975 | Boszor | 181/169 X |
| 4,190,746 | 2/1980 | Harwood et al. | 181/167 X |
| 4,359,132 | 11/1982 | Parker et al. | 181/169 |

*Primary Examiner*—Benjamin R. Fuller

*Attorney, Agent, or Firm*—Robert T. Mayer; Bernard Franzblau

[57] ABSTRACT

An electro-acoustic transducer comprising a diaphragm (1) and means for shifting the high-frequency roll-off of the frequency-response characteristic of the transducer towards lower frequencies. This is accomplished by making the diaphragm (1) permeable to air, the permeability to air over the entire surface area of the diaphragm being such that at least a passage of 50 liters of air per second per square meter is obtained for a pressure difference of 200 Pa (=200 N/m$^2$) between opposite sides of the diaphragm.

10 Claims, 6 Drawing Figures

ELECTRO-ACOUSTIC TRANSDUCER WITH HIGH AIR PERMEABLE DIAPHRAGM

Figure 1:
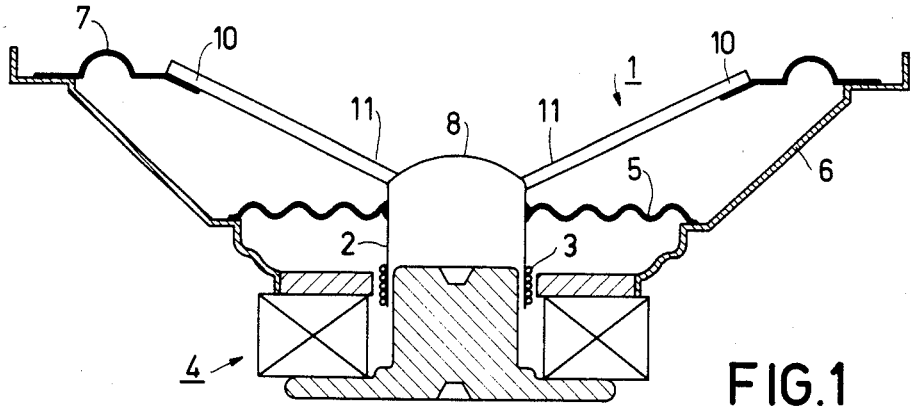

The invention relates to an electro-acoustic transducer comprising a diaphragm and means for shifting the high-frequency roll-off in the frequency response characteristic of the transducer towards lower frequencies. Such a transducer is disclosed in U.S. Pat. No. 2,007,750. The known transducer is an electrodynamic transducer with a mechanical filter coupled between a voice-coil former and a conical diaphragm.

It is to be noted that the invention is not limited to transducers of the electrodynamic type but that the invention may also be applied to different types of transducers, for example capacitive transducers. Moreover, the invention is not limited to transducers with a conical diaphragm, but may also be applied to transducers with dome-shaped or flat diaphragms.

In the known transducer the driving force is transmitted from the voice-coil former to the diaphragm via the mechanical filter. This filter has a low-pass characteristic so that the high-frequency roll-off of the frequency-response characteristic of the transducer is shifted towards lower frequencies.

One of the embodiments described in said Patent comprises a mechanical filter comprising a connecting ring of a compliant material. A disadvantage of the use of such a ring as a mechanical filter is that during use of the transducer, because the temperature of the voice coil and the voice-coil former becomes very high and because of the internal dissipation of the mechanical vibrations in the material of the mechanical filter, the temperature in the material of the mechanical filter may become very high so that the properties of the mechanical filter may change irreversibly. As a result, the filter and, consequently, the transducer no longer perform satisfactorily.

Moreover, said construction has the disadvantage that in the production line for said transducer an additional step is required in order to mount the compliant ring, which renders the transducer more expensive.

The invention aims at providing an electro-acoustic transducer which is cheaper and which moreover performs satisfactorily for a longer time. To this end the electro-acoustic transducer in accordance with the invention is characterized in that said means for shifting the high-frequency roll-off towards lower frequencies comprise the use of a diaphragm which has a certain degree of permeability to air over its entire diaphragm surface, the permeability to air of the diaphragm being such as to obtain a passage of at least 50 liters of air per second and per square meter for a pressure difference of 200 Pa ($=200\ N/m^2$) between the air pressures on both sides of the diaphragm.

The invention is based on the insight that the high-frequency roll-off of the frequency-response characteristic can be shifted towards lower frequencies in different ways namely, in accordance with the invention, by making the diaphragm permeable to air.

Prior art transducers comprise diaphragms which are impermeable to air, for example diaphragms of a plastics material, such as polypropylene, see U.S. Pat. No. 4,190,746. The paper cones of cone loudspeakers are also intended to be impermeable to air. However, these paper cones are porous and exhibit a certain degree of permeability to air. By measurements on paper cones of a large number of known cone loudspeakers the Applicant has found that this permeability to air corresponds to maximum passage of approximately 25 liters of air per second per square meter for a pressure difference of 200 Pa on each side of the diaphragm. By comparing frequency-response characteristics of transducers comprising plastic diaphragms with those of transducers comprising paper diaphragms the Applicant has found that the known transducers with paper diaphragms do not exhibit a high frequency roll-off at lower frequencies. For this comparison all further physical parameters of both types of transducer were the same. It has been found that a significant shift of the high-frequency roll-off towards lower frequencies can be achieved only when the permeability to air is increased substantially. This increased permeability to air appears to correspond to the afore-mentioned passage of 50 liters per second per square meter under the specified conditions.

The permeability to air of the diaphragm contains a component representing an acoustic resistance to acoustic waves. The permeability to air can now be dimensioned in such a way that for the low-frequency portion of the frequency response characteristic of the transducer the overall acoustic resistance of the diaphragm is substantially higher than the acoustic radiation impedance (with which it is effectively in parallel). The vibration behaviour of the diaphragm and the sound radiation for low frequencies therefore remain substantially the same as for a transducer with a fully air-tight diaphragm.

Owing to the inductive component in the radiation impedance, this radiation impedance increases as the frequency increases. As a result of this, the permeability to air of the diaphragm becomes apparent at higher frequencies. This more or less has the effect of a leakage of the acoustic waves through the diaphragm. In comparison with a fully air-tight diaphragm the radiation of sound by a diaphragm which is permeable to air will be lower, resulting in a high-frequency roll-off which begins at lower frequencies. This roll-off has a slope of about 6 dB per octave.

In the foregoing it has been assumed that the diaphragm which is permeable to air has the same mechanical properties as the original air-impermeable diaphragm, so that the vibration behaviour is the same.

It is to be noted that British Patent Specification No. 854,851. German Offenlegungsschrift No. 22.52.189 and U.S. Pat. No. 2,022,060 disclose transducers comprising a diaphragm provided with one or more perforations. However, the dimensions of these perforations are such that the desired effect of shifting the high-frequency roll-off cannot be achieved. Moreover, the permeability to air is distributed discontinuously over the diaphragm surface area. Only a few isolated perforations are made distributed over the diaphragm surface.

The permeability to air is preferably substantially uniform over the entire surface area of the diaphragm. This is easiest to achieve if the diaphragm is flat. For conical diaphragms this cannot be accomplished in a simple manner. Since cones are pressed from a layer of cone material whose permeability to air is uniformly distributed over the surface area, the permeability to air after the cones have been pressed will be smaller at the periphery than in the centre.

The magnitude of the acoustic resistance representing the diaphragm which is permeable to air can be varied by varying the degree of permeability to air. In this way the variation of the high-frequency roll-off can be controlled, namely in such a way that a higher permeability to air, which corresponds to a lower acoustic resistance, results in the high-frequency roll-off being shifted towards lower frequencies.

Generally, electro-acoustic transducers are provided with a compliant rim which is secured between the outer circumference of the diaphragm and the chassis of the transducer. Such a rim functions as an outer suspension for the diaphragm. In accordance with the invention the compliant rim also has a certain permeability to air, the permeability to air of a layer of the material of the compliant rim also being such that at least a passage of 50 liters of air per second and per square meter is obtained for a pressure difference of 200 Pa between the air pressures on each side of the layer of the material. In this way it is avoided that the shift of the high-frequency roll-off towards lower frequencies is disturbed by a high-frequency frequency contribution to the acoustic waves radiated from the compliant rim.

The diaphram may comprise a textile fabric or a non-woven fibrous material which is reinforced by means of a thermosetting or thermoplastic binder. Since the binder adheres to the fibers, especially at locations where the fibers are closest to each other, a secure connection between the fibers is achieved so that a sufficiently stiff diaphragm can be obtained. Moreover, owing to the local adhesion, pores are left in the material so that it becomes permeable to air. Moreover, the permeability to air of the diaphragm can be controlled by varying the concentration of the binder.

Figure 3:
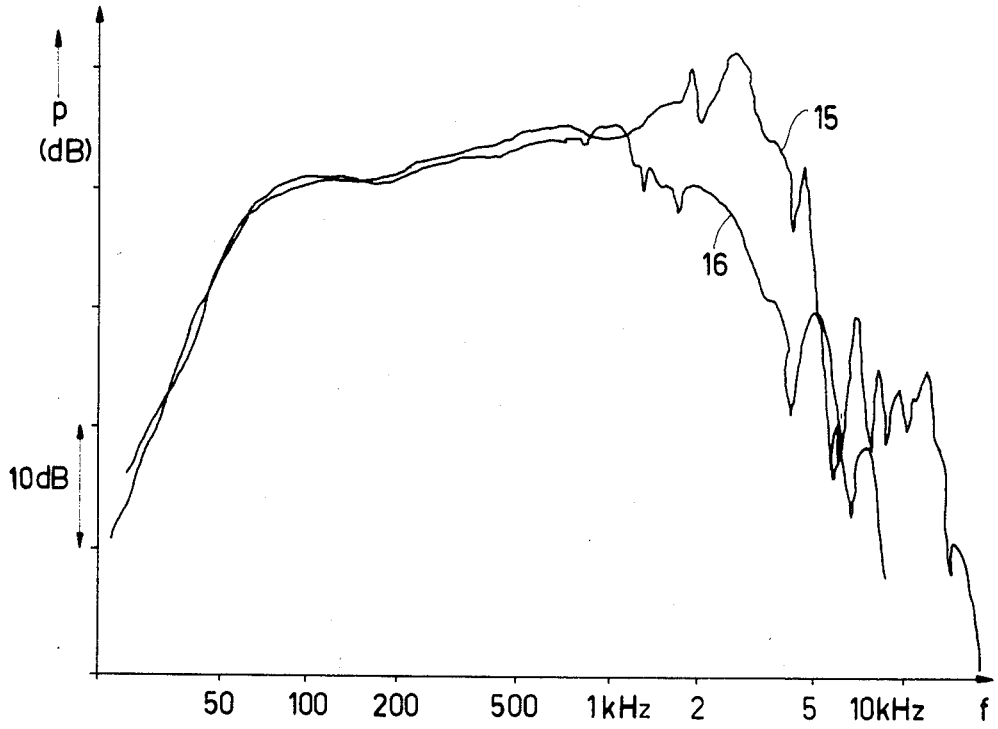
Figure 4:
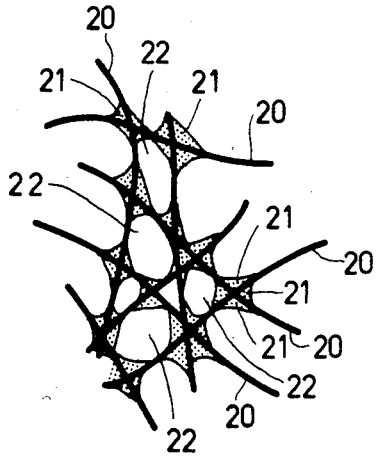

The invention will now be described in more detail, by way of example, with reference to the drawings. In the drawings:

FIG. 1 shows an electro-acoustic transducer in accordance with the invention, FIGS. *2a–2c* shows three impedance-type electrical equivalent diagrams of the transducer shown in FIG. 1, FIG. 3 shows two frequency-response characteristics, and FIG. 4 is an (enlarged) view of the diaphragm.

FIG. 1 is a sectional view of a transducer in accordance with the invention. The transducer takes the form of a voice-coil loudspeaker having a conical diaphragm 1. The inner rim of the diaphragm 1 is secured to a voice-coil former 2 on which a voice coil 3 is arranged. The voice-coil former with the voice coil can move in a gap formed in a magnet system 4. The construction of the magnet system is of a conventional type and requires no further explanation because the invention does not relate to steps affecting the magnet system. Therefore, the scope of the invention is not limited to those transducers whose magnet system is constructed in exactly the same way as that shown in FIG. 1. The voice-coil former 2 is secured to the loudspeaker chassis 6 via a centring ring 5. The outer rim of the diaphragm 1 is also secured to the loudspeaker chassis 6 via a compliant rim (or centring ring) 7. The voice-coil former is closed by a dust cap 8.

The transducer is provided with means for shifting the high-frequency roll-off in the frequency-response characteristic of the transducer towards lower frequencies. In order to obtain this shift in frequency the diaphragm is made permeable to air over its entire surface area, as is the centring ring 7. This permeability is sufficient to obtain a passage through the diaphragm of at least 50 liters per second per square meter for a difference of 200 Pascals between the air pressures on the two sides of the diaphragm. As stated in the foregoing, the permeability to air of the conical diaphragm 1 will not be the same over the entire surface area, but will be lower at the outer rim 10 than at the more inward location indicated by the reference numeral 11. This is because a conical diaphragm is pressed from a flat layer of diaphragm material. The apex of the cone is pressed out of the plane represented by the layer of diaphragm material. The part of the diaphragm around the apex of the cone has therefore been subjected to the highest degree of expansion. Starting from a layer of diaphragm material whose permeability is uniform over the entire surface area, the permeability of the part of the diaphragm around the apex will have increased after pressing owing to the expansion of the material. In this case, i.e., of a permeability which is non uniform over the diaphragm surface, the permeability is such that it is sufficient overall to give the specified air flow of at least 50 l/s $m^2$ for the relevant pressure difference.

The operation of the transducer shown in FIG. 1 will be explained with reference to the equivalent diagram shown in FIGS. *2a–2c* is an impedance-type equivalent diagram of the transducer shown in FIG. 1 when this transducer is incorporated in an infinitely large wall (baffle). For the correct operation of the transducer it must be incorporated in an infinitely large wall or in a closed box, thereby precluding the acoustic short-circuit which would occur between the acoustic waves radiated by the one side and the other side of the diaphragm without the use of the baffle or the box.

FIG. *2a* shows the complete equivalent diagram. The diagram comprises three sections. The section designated I is the electrical section. The terminals 12—12' serve for connecting the electric signal source. Via an electrical impedance $Z_e$, corresponding to the resistance and the inductance of the voice coil, the terminals 12—12' are coupled to one side of a gyrator 13. The section designated II is the mechanical section. The other side of the gyrator 13 is coupled to one side of a transformer 14 via the impedance $Z_m$. The impedance $Z_m$ comprises a series arrangement of a capacitance, a resistance and an inductance, which are the electrical analogues of the suspension, the mass and the mechanical damping of the moving parts of the transducer, i.e. the diaphragm, the voice coil, and the voice-coil former, respectively. The section designated III is the acoustic section. The other side of the transformer 14 is coupled to the parallel arrangement of an impedance Zam, corresponding to the acoustic impedance caused by the permeability to air of the diaphragm 1, and an impedance $2Z_{ar}$, corresponding to the acoustic radiation impedance exerted on the front and the rear of the diaphragm (hence the factor 2) by the surrounding medium. The gyrator 13 defines the following relationships between the electrical and the mechanical section:

$$F_s = Bli \tag{1a}$$

$$Y_s = 1/Blu \tag{1b}$$

Herein i is the current through the voice coil, B the magnetic inductance in the air gap of the magnet system 4, l the length of the conductor of the voice coil, $F_s$ the force exerted on the voice coil, u the back-EMF, and $v_s$ the velocity of the voice coil (and consequently of the diaphragm). The transformer 14 defines the following relationships between the mechanical and the acoustic section:

$$F_1 = S_m \cdot p_m \tag{2a}$$

$$v_v = s_m \cdot v_s \quad (2b)$$

Here $F_1$ is the force exerted on the surrounding air by the diaphragm, $S_m$ is the diaphragm surface area, $P_m$ is the sound pressure at the location of the diaphragm and $v_v$ the volume velocity of the acoustic waves.

Thus, in an impedance-type equivalent diagram forces and (sound) pressures are represented by voltages and (volume) velocities by currents.

For the further explanation it suffices to describe only the mechanical and acoustic sections in more detail. The electrical section is ignored in order to simplify the description. This is permissible because the influence of the electrical section is negligible compared with the influence of the other components.

Figure 2:
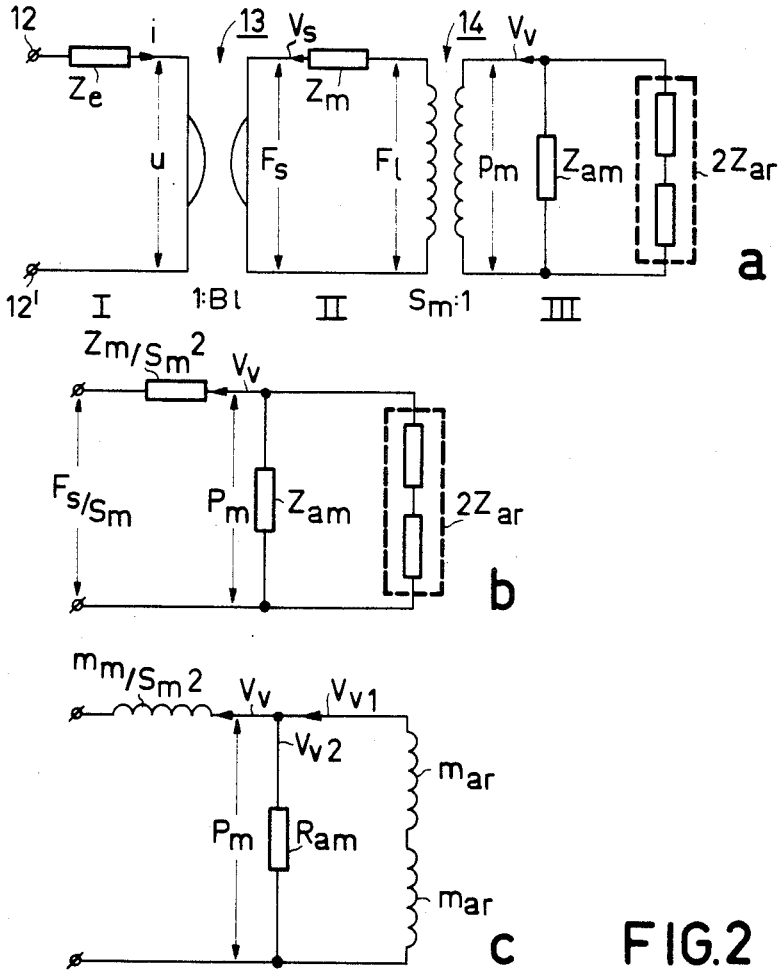

FIG. 2*b* only shows the mechanical and the acoustic section, the mechanical section being transferred to the acoustic section. For higher frequencies (intended are frequencies above the transducer resonant-frequency, which determines the lower limit of the operating frequency range or frequency response of the transducer) the diaphragm shown in FIG. 2*b* may be simplified to the diagram shown in FIG. 2*c*. For high frequencies f the induction component $m/_m/S_m^2$ in the impedance $Z_m/S_m^2$ preponderates. Similarly, the inductive component $m_{ar}$ is preponderant in the radiation impedance $Z_{ar}$. Since the permeability to air of the diaphragm mainly has an acoustic resistance function, $Z_{am}$ may be replaced by $R_{am}$. The (very) small inductive component in $Z_{am}$ remains small relative to $R_{am}$ also for high frequencies, so that this component may be omitted. For the diagram of FIG. 2*c* the sound pressure $p_m$ can be calculated for two situations, namely one in which $R_{am}$ is infinitely high, i.e. the diaphragm is impermeable to the acoustic waves, and one in which the diaphragm is permeable to the acoustic waves, i.e. $R_{am} << \infty$. The following formula is valid for an impermeable diaphragm:

$$p_m(R_{am} = \infty) = v_{v1} \cdot 2\,jwm_{ar} = v_v \cdot 2\,jwm_{ar} \quad (3)$$

$$= \frac{F_s/S_m}{m_m/S_m^2 + 2m_{ar}} \cdot 2\,m_{ar}$$

A diaphragm which is permeable to air complies with:

$$p_m(R_{am} << \infty) = \frac{F_s/S_m}{m_m/S_m^2 + 2m_{ar}} \cdot 2m_{ar}\left[\frac{R_{am}}{R_{am} + jwm^*}\right] \quad (4)$$

in which $w = 2\pi f$ and $m^*$ represents the parallel arrangement of $2m_{ar}$ and $m_m/S_m^2$. This means that $$m^* = \frac{2m_{ar} \cdot m_m/S_m^2}{2m_{ar} + m_m/S_m^2}$$

The term in brackets in formula (4) represents an additional high-frequency roll-off in the frequency response characteristic of a transducer with a diaphragm which is impermeable to air, i.e. $p_m(R_{am} = \infty)$. The cut-off frequency of this high-frequency roll-off is situated roughly at $$\frac{1}{2\pi} \frac{R_{am}}{m^*}$$

so that $R_{am}$ and consequently the permeability to air of the diaphragm may be selected so as to obtain a roll-off from a specific desired frequency, namely a frequency below the frequency which represents the upper limit in the frequency-response characteristic of a transducer with a diaphragm which is impermeable to air.

FIG. 3 shows the results of two measurements. One measurement has been carried out on a transducer provided with an air-impermeable diaphragm, see the frequency-response characteristic 15, and one measurement has been carried out on the same transducer provided with a diaphragm which is permeable to air. The frequency-response characteristic for this transducer is designated 16. In the frequency response characteristics the sound pressure p in dB's is plotted as a function of the frequency f. It is clearly visible that the high-frequency roll-off of the frequency characteristic 16 commences at lower frequencies than the high-frequency roll-off of the frequency-response characteristic 15.

If the transducer is incorporated in a loudspeaker box an additional low-frequency roll-off is produced as a result of the resistance $R_{am}$ and the compliance of the box volume. The compliance manifests itself as a capacitance $C_{ab}$ in series with the radiation impedance $Z_{ar}$ in FIG. 2. By a suitable choice of $R_{am}$ and $C_{ab}$ the cut-off frequency of this low-frequency roll-off can be selected in such a way that it is situated below the resonant frequency of the transducer and consequently below the lower limit of the operating-frequency range of the transducer, so that this low-frequency roll-off will not affect the operation of the transducer.

A variation of the permability to air of the diaphragm and hence of the acoustic resistance $R_{am}$ also results in a variation of the cut-off frequency for this low-frequency roll-off, namely in such a way that a higher permeability to air, i.e. a lower acoustic resistance (which is desirable for shifting the high-frequency roll-off towards-even-lower frequencies), results in the cut-off frequency for the low-frequency roll-off being shifted towards higher frequencies. Since the cut-off frequency for the low-frequency roll-off must be situated below the resonant frequency of the transducer and, consequently, below the lower limit of the operating frequency range of the transducer, the variation of the cut-off frequency for the low-frequency roll-off towards higher frequencies is limited. For the variation of the cut-off frequency of the high-frequency roll-off this means that it is limited towards lower frequency. Therefore, the choice of the cut-off frequency for the high-frequency roll-off is sometimes a compromise between a high-frequency roll-off at the lowest possible frequency and a low-frequency roll-off which is still situated below the resonant frequency of the transducer. Preferably, the compliant rim (or centering ring) 7 is also permeable to air. In this way it is avoided that for high frequencies this rim still contributes to the sound radiation.

A diaphragm, in accordance with the invention, which is permeable to air can be made in various ways. The basic material is a textile fabric or a non-woven material, for example cotton, glass, polyamide, polyester or polypropylene fibers. This enumeration is non-limitative because other materials may also be used.

Furthermore, a thermosetting binder (for example epoxy or phenolic resins) or a thermoplastic binder (for example styrene-butadiene rubber (SBR), polyurethane, polyacrylate, polypropylene, a low-melting polyester or polyethylene) is added.

Some processes are described in more detail.

(1) The textile fabric or the non-woven material is soaked in a thermosetting binder. Subsequently, the impregnated material is pressed into the correct shape at high temperature. A chemical reaction takes place. The binder polymerizes and adheres to the fibers mainly at those locations where the fibers are closest to each other or in contact with each other. The resulting bond provides the required stiffness. Moreover, a sufficient number of pores are left so that the material remains permeable to air.

(2) Thermoplastic binders may be used in two ways.

(a) When styrene-butadiene rubber, polyacrylate or polymethane is employed as a binder the textile fabric or the non-woven material is soaked in a solution or emulsion of the binder. Subsequently, the soaked material is preheated and then pressed at low temperature to give the diaphragm its final shape. During preheating a physical reaction takes place. The binder melts and adheres to the fibers in the same way as described under (1).

(b) When polypropylene, a low-melting point polyester or polyethylene is used (generally in the form of fibers) as a binder material, the fibers of the binder are mixed with the textile fabric or the non-woven material. The binder material has a lower melting point than the textile fabric or the non-woven material. The mixture is pressed between hot rollers so that the binder also melts and adheres to the fibers of the textile fabric or the non-woven material. When the material is still warm it is subsequently pressed at low temperature to give the diaphragm its final shape.

The foregoing is not an exhaustive description of the methods by means of which diaphragms in accordance with the invention can be manufactured. Diaphragms in accordance with the invention can be manufactured by methods other than the three methods described above.

FIG. 4 shows a part of a diaphragm which can be manufactured using one of the methods described above. In contradistinction to the textile fabric, in which the fibres are nearly interwoven, this is a non-woven fiber material. The fibers are designated 20. The binder material 21 is situated at the areas, where the fibers lie closest to each other (i.e. touch each other or cross each other very closely). Between these areas the pores 22 are formed which provide the permeability to air.

It is to be noted that the invention is not limited to the embodiment as shown in FIG. 1. The invention may also be applied to those transducers which differ from the embodiment described with respect to points which are not relevant to the present invention. For example, the diaphragm may be flat or dome-shaped rather than conical. As mentioned previously, if it is flat its permeability to air is preferably uniform over its entire area.

What is claimed is:

1. An electro-acoustic transducer comprising a diaphragm and means for shifting the high-frequency roll-off in the frequency-response characteristic of the transducer towards lower frequencies, wherein said means for shifting the high-frequency roll-off towards lower frequencies comprise a diaphragm having a certain degree of permeability to air over its entire diaphragm surface, the permeability to air of the diaphragm providing a passage of at least 50 liters of air per second and per square meter for a pressure difference of 200 Pa (=200 $N/m^2$) between the air pressures on opposite sides of the diaphragm.

2. An electro-acoustic transducer as claimed in claim 1 wherein the diaphragm comprises a flat diaphragm in which the permeability to air is at least substantially uniform over the entire surface area of the diaphragm.

3. An electro-acoustic transducer as claimed in claim 1 further comprising a compliant rim secured between an outer circumference of the diaphragm and a chassis of the transducer, characterized in that the compliant rim also has a certain permeability to air, the permeability to air of a layer of the material of the compliant rim also providing at least a passage of 50 liters of air per second and per square meter for a pressure difference of 200 Pa between the air pressures on each side of a layer of the material.

4. An electro-acoustic transducer as claimed in claim 1 wherein the diaphragm comprises a textile fabric or a non-woven fibrous material reinforced by means of a thermosetting or thermoplastic binder.

5. An electro-acoustic transducer as claimed in claim 2 further comprising a compliant rim secured between an outer circumference of the diaphragm and a chassis of the transducer, characterized in that the compliant rim also has a certain permeability to air, the permeability to air of a layer of material of the compliant rim also providing at least a passage of 50 liters of air per second and per square meter for a pressure difference of 200 Pa between the air pressures on each side of a layer of the material.

6. An electro-acoustic transducer as claimed in claim 3 wheren the diaphragm comprises a textile fabric or a non-woven fibrous material reinforced by means of a thermosetting or thermoplastic binder.

7. An electro-acoustic transducer comprising:

a magnet system having an air gap therein, a coil former with a voice coil thereon movably mounted in said air gap, and a diaphragm secured to the coil former and to a chassis of the transducer, said diaphragm having a given permeability to air over its surface so as to pass therethrough at least 50 liters of air per second/per square meter for a pressure difference of 200 Pa across said diaphragm.

8. An electro-acoustic transducer as claimed in claim 7 wherein the diaphragm comprises a conical diaphragm, said transducer further comprising a compliant rim secured between an outer periphery of the diaphragm and the chassis thereby to resiliently secure the diaphragm to the chassis.

9. A diaphragm for a loudspeaker comprising a layer of textile fabric or a non-woven fibrous material reinforced by a thermosetting or thermoplastic binder to provide an overall high porous diaphragm having a permeability to air over its entire surface area that allows the passage of at least 50 liters of air per second/per square meter for a pressure difference of 200 Pascals between air pressures on opposite sides of the diaphragm thereby to shift the high-frequency roll-off in the frequency response characteristic of a loudspeaker incorporating said diaphragm in the direction of lower frequencies.

10. A diaphragm as claimed in claim 9 wherein said layer of textile fabric or non-woven fibrous material is selected from the group consisting of cotton, glass, polyamide, polyester and polypropylene fibers and the binder is selected from the group consisting of epoxy or phenolic resins, styrene-butadiene rubber, polyurethane, polyacrylate, polypropylene, and low-melting polyester and polyethylene.

* * * * *